US007818943B2

(12) United States Patent
Dziwak

(10) Patent No.: US 7,818,943 B2
(45) Date of Patent: Oct. 26, 2010

(54) TRACK JACK SYSTEM

(75) Inventor: Zygmunt Dziwak, Mississauga (CA)

(73) Assignee: The Peelle Company Ltd., Ontario (CA)

( * ) Notice: Subject to any disclaimer, the term of this patent is extended or adjusted under 35 U.S.C. 154(b) by 229 days.

(21) Appl. No.: 11/875,165

(22) Filed: Oct. 19, 2007

(65) Prior Publication Data

US 2008/0035817 A1 Feb. 14, 2008

Related U.S. Application Data

(62) Division of application No. 11/033,092, filed on Jan. 10, 2005, now Pat. No. 7,322,555.

(51) Int. Cl.
*A47H 1/10* (2006.01)

(52) U.S. Cl. ..... 52/745.15; 52/126.3; 187/340; 248/265; 248/297.21; 248/327; 49/120; 49/452; 16/94 R

(58) Field of Classification Search ..... 52/745.15, 52/126.3, 126.4; 187/336, 333, 335, 340; 248/257, 265, 269, 297.21, 327; 49/409, 49/452, 120, 370; 16/90, 94 R
See application file for complete search history.

(56) References Cited

U.S. PATENT DOCUMENTS

| | | | | | |
|---|---|---|---|---|---|
| 348,976 | A | * | 9/1886 | Kasson | 16/94 R |
| 0,595,180 | A | | 12/1897 | Kustler | |
| 708,205 | A | * | 9/1902 | Clift | 16/102 |
| 836,952 | A | * | 11/1906 | Willour | 16/101 |
| 856,607 | A | * | 6/1907 | Schuyler et al. | 16/94 R |
| 1,236,269 | A | | 8/1917 | Cole | |
| 1,422,473 | A | | 7/1922 | Phillips | |
| 2,904,821 | A | * | 9/1959 | Birkmeyer, Sr. | 16/94 R |
| 3,426,480 | A | | 2/1969 | Dzamba | |
| 3,468,509 | A | * | 9/1969 | Foltz | 248/316.6 |
| 4,099,599 | A | | 7/1978 | Randall | |
| 4,344,206 | A | * | 8/1982 | Hermanson | 16/94 R |
| 5,165,505 | A | * | 11/1992 | Hayashi et al. | 187/333 |
| 5,706,913 | A | | 1/1998 | Rivera | |
| 5,887,681 | A | | 3/1999 | Bondavalli | |
| 6,142,260 | A | | 11/2000 | Shin | |
| 6,336,247 | B1 | | 1/2002 | Schnoor | |
| 2002/0029937 | A1 | | 3/2002 | Kalm et al. | |

FOREIGN PATENT DOCUMENTS

| | | | |
|---|---|---|---|
| JP | 61-183383 | U | 11/1986 |
| JP | 09-240971 | A | 9/1997 |
| JP | 11-011841 | A | 1/1999 |

* cited by examiner

*Primary Examiner*—Brian E Glessner
(74) *Attorney, Agent, or Firm*—Pearne & Gordon LLP

(57) ABSTRACT

A method and apparatus for adjustably mounting tracks that suspend horizontal sliding doors at a freight elevator landing. The apparatus comprises a plurality of brackets adapted to be mounted in the shaft on the header above the landing opening. The brackets are each secured to the header with anchor bolts. Each anchor bolt is set in the header but initially allows vertical movement of the bracket. An adjusting screw, carried on each bracket, is arranged to easily and precisely move the bracket up or down relative to the anchor bolt as needed to position the tracks and, therefore, the door panels at a proper height. Once adjusted such that a specified gap is established between the lower edges of the door panels and the threshold, each anchor bolt can be tightened to fix its respective bracket in its adjusted position.

4 Claims, 4 Drawing Sheets

TRACK JACK SYSTEM

This application is a division of application Ser. No. 11/033,092, filed Jan. 10, 2005, now U.S. Pat. No. 7,322,555.

BACKGROUND OF THE INVENTION

The invention relates to a sliding door system for freight elevator landings and, more particularly, to a door suspension system that is easily and quickly installed and adjusted.

PRIOR ART

Horizontal sliding doors for freight elevator landings are typically suspended from overhead tracks. Building codes and good workmanship dictate that the door panels have a limited clearance with the sill plate at the landing floor. Achieving a certain working clearance without exceeding specified limits can be tedious and time-consuming. Typically, a door system is installed by attaching various hardware components to the existing building. Relevant parts of the building are ordinarily of masonry construction and by the nature of such construction, are neither perfectly flat nor regular in hardness and finish. These physical conditions make it difficult for even a skilled installer to initially mount system hardware in a precise location. Prior art arrangements for adjusting the door panels vertically have been less than ideal, requiring, for example, individual adjustment of each door with eccentric roller mounts or use of spacers. Eccentric roller mounts give a non-linear response to adjustment and can throw a panel out of plumb each time one of a pair of rollers is adjusted. Use of spacers, known in the art, is typically troublesome from both a manufacturing standpoint and an installer's perspective. Where door panels in prior art arrangements are individually vertically adjusted, the time required to set all of the panels will ordinarily be proportional to the number of door panels being installed.

SUMMARY OF THE INVENTION

The invention relates to an improved system for suspending horizontal sliding door panels at freight elevator landings that reduces installation time and effort while, at the same time, being simple and economical to manufacture. The system has a vertical adjustment arrangement that facilitates the original installation of the overhead track for the door panels and, additionally, serves to provide for the final vertical adjustment of the door panels. The arrangement, moreover, preferably, uses a screw to raise or lower the track components and door panels with relative ease and with linear, stepless precision.

In the preferred embodiment, the invention includes a plurality of wall mounted brackets that suspend overhead tracks for the sliding door panels. The brackets are situated along the header over the landing opening. The brackets are each initially attached to the wall with an anchor bolt that, besides securing the bracket to the wall, serves as a vertically fixed peg or platform on which the bracket can be jacked up or down. The bracket assembly has a vertically slotted leg and an apertured block which together are assembled on an exposed portion of the installed wall anchor. A jacking screw carried in a threaded hole in the bracket body bears against the block enabling this screw to raise or lower the bracket relative to the anchor with the vertical slot accommodating this motion. Several identical or similar brackets are installed in the same manner along the entrance header to collectively support the tracks from which the door panels are suspended.

DESCRIPTION OF THE PREFERRED EMBODIMENT

Figure 1:
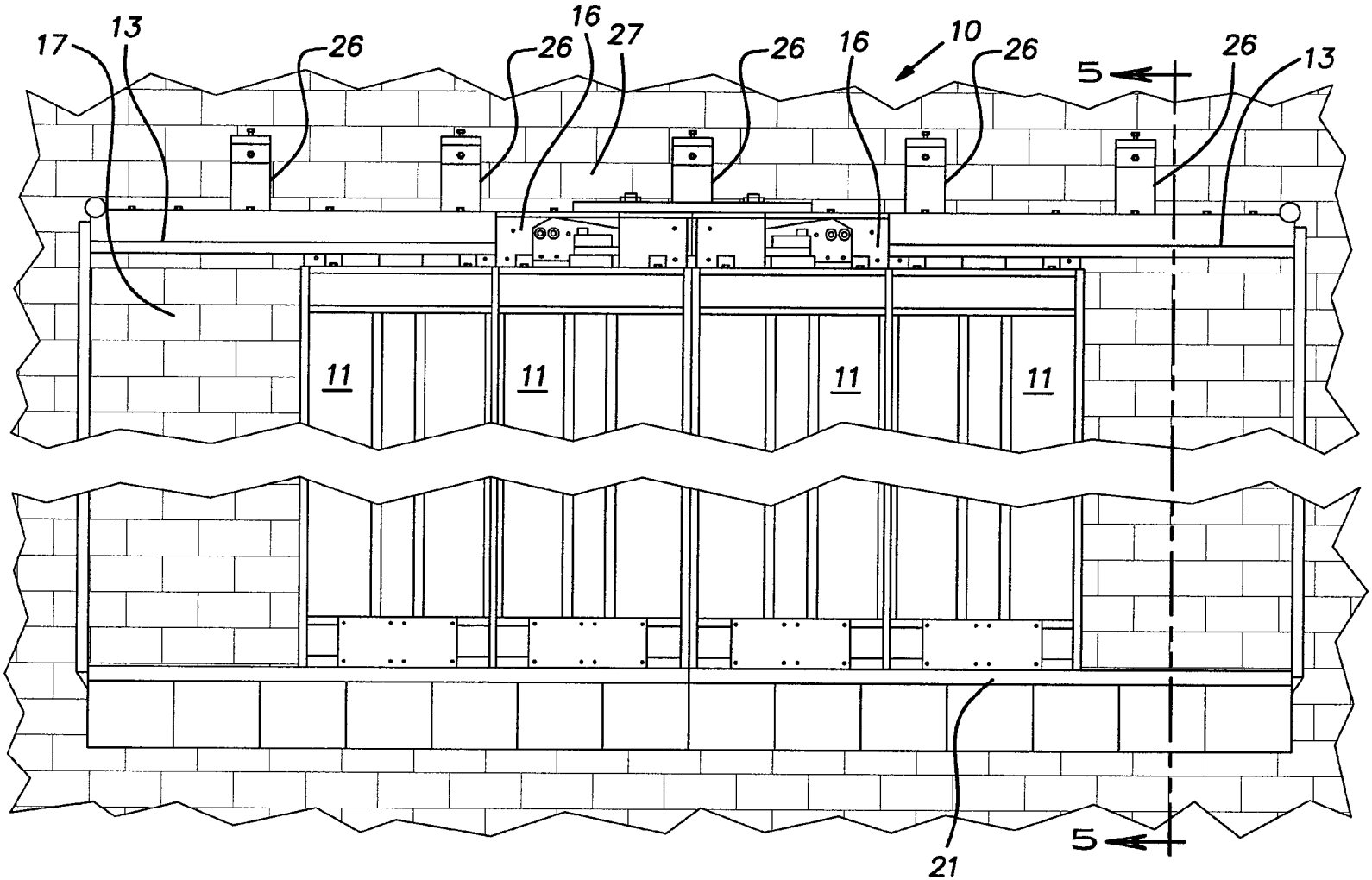
FIG. 1 is a somewhat schematic fragmentary elevational view of a freight elevator landing door assembly as seen from the shaft.
Figure 2:
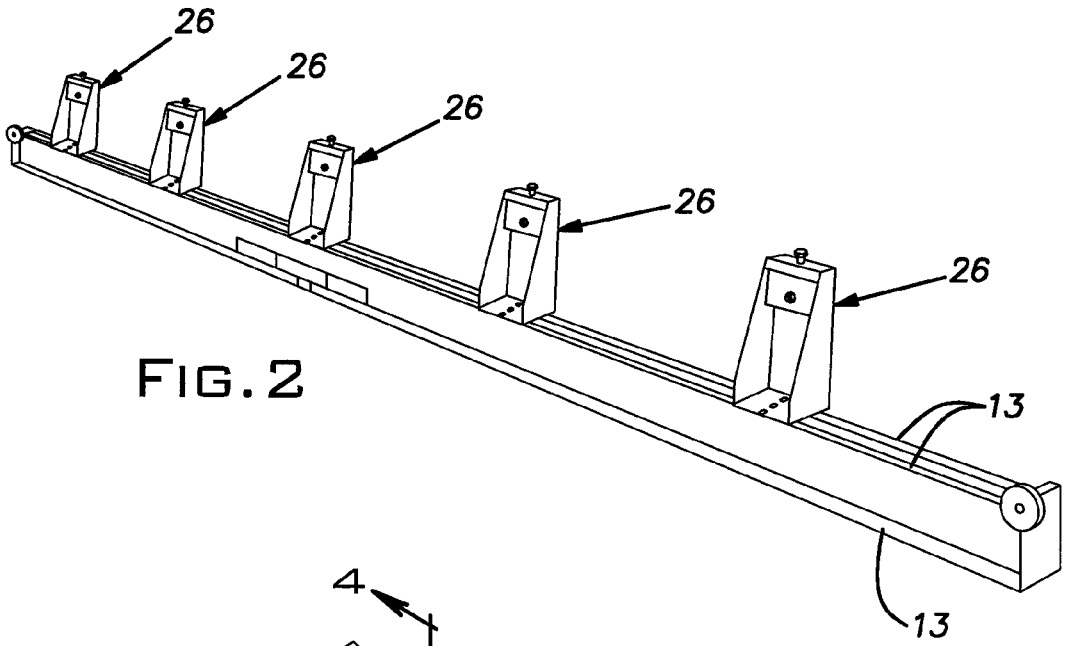
FIG. 2 is a perspective view of the tracks and supporting brackets of the door assembly.

Referring now to the drawings and in particular to FIG. 1, there is shown, from the shaft side, a freight elevator landing door installation 10 including a set of four horizontal sliding door panels 11 in a closed position. The door panels 11 protect an opening to the elevator shaft at a landing. The panels 11 are suspended from overhead tracks 13 in a generally conventional manner. Each panel 11 has a pair of associated traction rollers 14 that roll on a horizontal surface 23 (FIG. 5) of a respective track 13. The rollers 14 of each panel are mounted on a bracket 16 (FIG. 5), a separate bracket being associated with each panel 11. Preferably, each bracket 16 (FIG. 5) is bolted to the top edge of a respective panel 11. The door panels 11 in the illustrated case are in pairs, two associated with the left (as viewed in the figures) and two associated with the right. The panels 11 of each pair are in staggered vertical planes with the outer panels adjacent the plane of the shaft or building wall, designated 17, and the central panels spaced from the wall slightly more than the thickness of the outer panels. The panels 11 can be identical or nearly identical in construction, as desired.

Figure 5:
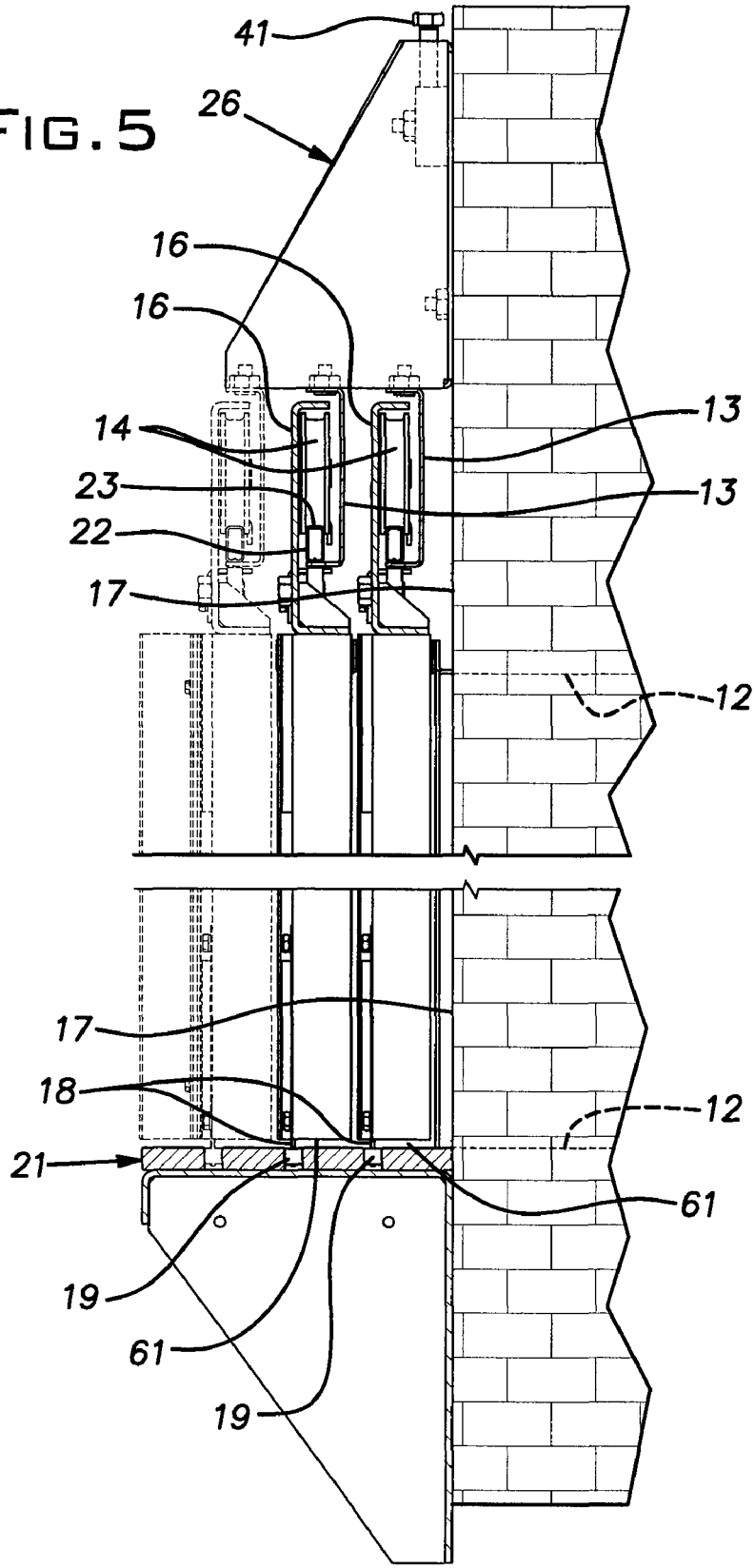
FIG. 5 is a fragmentary cross-sectional view of the door assembly taken in the plane 4-4 indicated in FIG. 1.

With reference to FIG. 5, the bottoms of the door panels 11 are guided by gibs 18. Preferably, a pair of gibs is associated with each panel. The gibs 18, which are bolted to the panels to enable their replacement, are received in and slide along respective slots 19 in a sill assembly 21.

The illustrated suspension tracks 13 are fabricated from steel stock into a J-shape with the hook end including a rectangular tube 22 or an equivalent form to provide the horizontal roller support surface 23. The tracks 13 (FIG. 4) are secured to the underside surfaces 24 of a plurality of bracket assemblies 26 spaced along the header, designated 27 (FIG. 1) of the opening 12 (FIG. 5).

The bracket assemblies 26 (FIG. 4) can be identical (with the exception that the central bracket can have a double set of track mounting slots). A main body 28 of the bracket assembly 26 can be made, preferably, of a single sheet of steel bent and welded into the illustrated shape. The main body includes a vertical leg 31 and a horizontal leg 32. The lateral edges of the legs 31, 32 are interconnected by triangular gussets 33. The top of the bracket 28 has a horizontal web 34 and a downwardly extending reinforcing flange 36. The web 34 is integral with the vertical leg 31 and the downwardly extending flange is integral with the web. The web 34 and flange 36, preferably, are welded at their lateral edges to the gussets 33. A boss 37 is welded or otherwise fixed at a hole 38 in the web 34 centered between the gussets and has a vertical internally threaded bore 39. A jacking screw 41 in the form of a threaded machine bolt, is assembled in the threaded boss 37. A vertical slot 42 in the vertical bracket leg 31 is centered between the gussets 33 and a round hole 43 is formed through the vertical bracket leg on a common vertical center line with the slot. Thus, preferably, the slot 42 and hole 43 are symmetrically disposed about a vertical plane perpendicular to the vertical bracket leg 31 and passing through the axis of the jacking screw 41.

Figure 3:
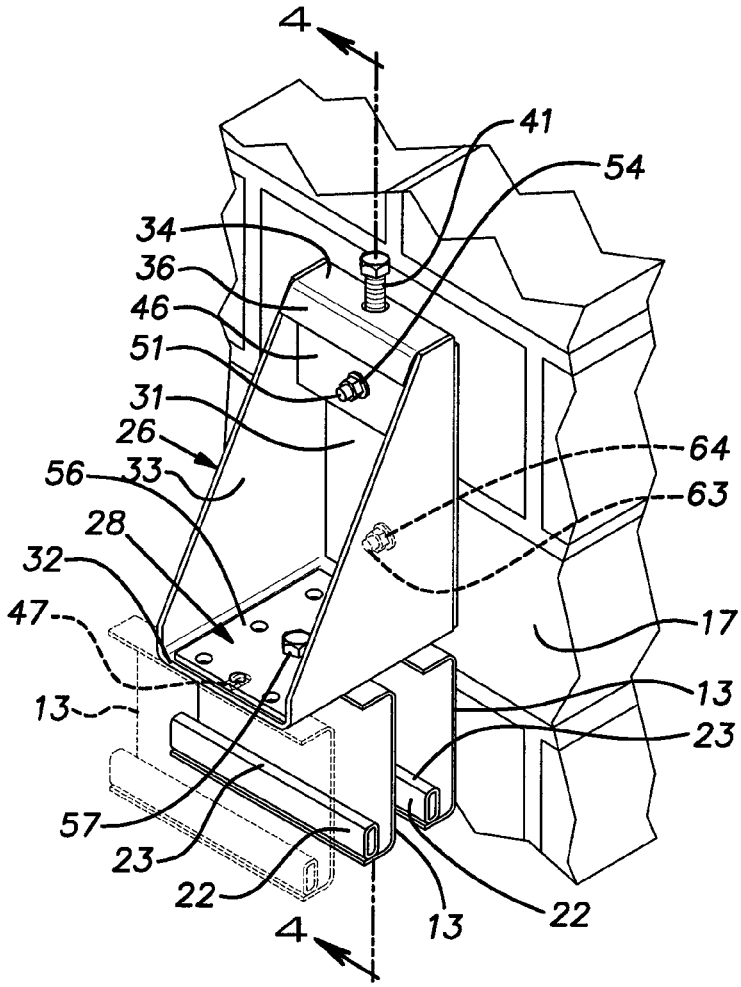
FIG. 3 is a perspective view of a typical track mounting bracket and portions of tracks.

A rectangular block 46, preferably of steel, is proportioned to slide vertically between the gussets 33 and includes a central hole that aligns with the slot 42. The block 46 has a thickness sufficient when in contact or near contact with the vertical bracket leg 31 to extend under the jacking screw 41 and, ideally, completely under its diameter to provide a full bearing surface for the end face of the screw. The horizontal bracket leg 32 has a series of slots 47, each slot overlying a respective one of the tracks 13. The illustrated brackets 16 are arranged to support three tracks corresponding to a six-panel door. For illustrative purposes, the third track is shown in phantom (FIG. 3).

Figure 4:
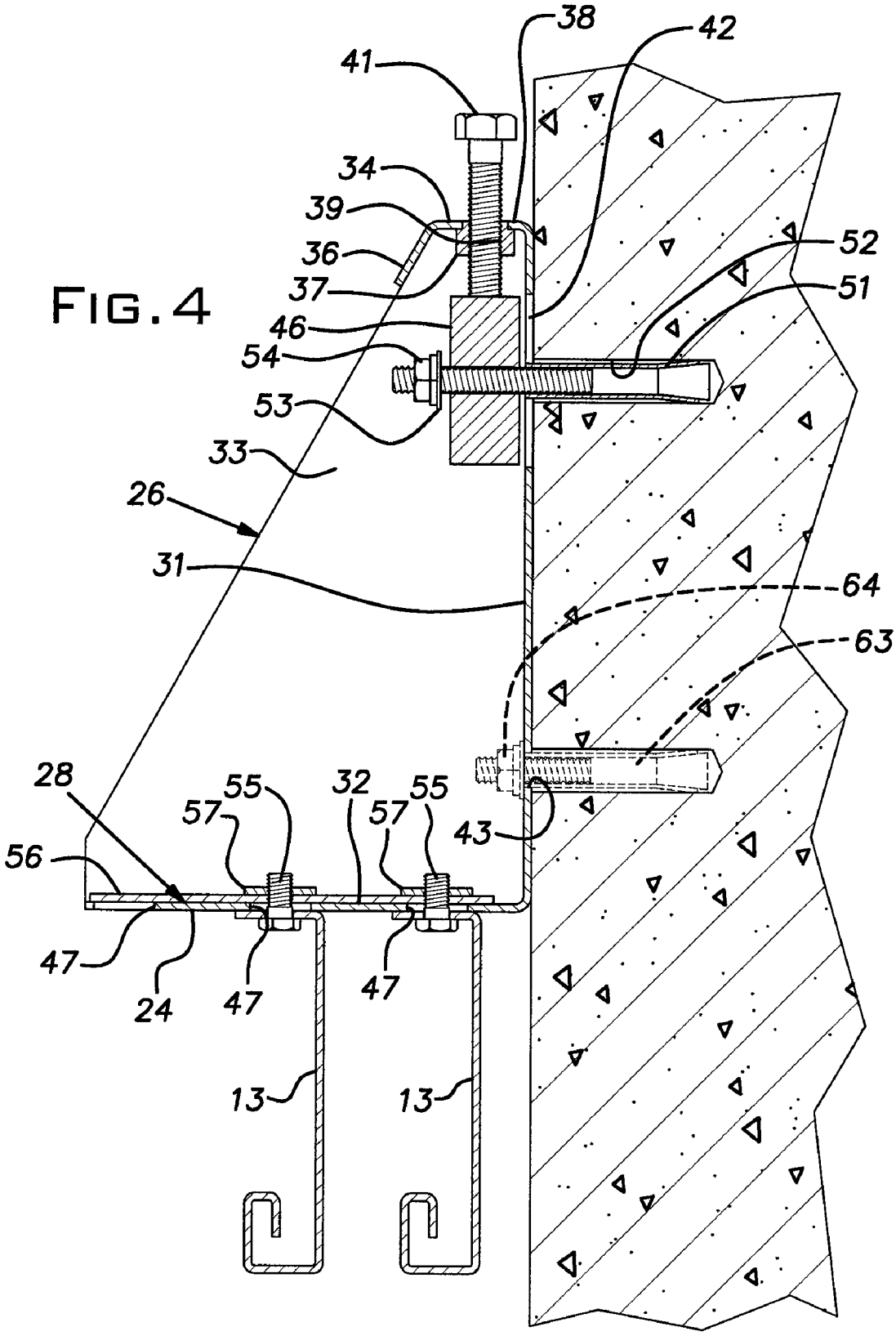
FIG. 4 is a cross-sectional view of a typical bracket taken in the plane 4-4 indicated in FIG. 3.

The door installation 10 (FIG. 1) can be initiated by mounting a sill assembly 21 at the shaft wall 17 at the level of the landing floor with appropriate masonry anchor bolts or other accepted technique. Thereafter, a bracket assembly 26 can be mounted on the shaft wall 17 centered above the door opening a specified distance above the sill assembly 21. This is accomplished by first drilling a hole in the header area 27 of the wall 17 sized to work with a specified anchor bolt. Thereafter, with an anchor bolt 51 positioned in the drilled hole, designated 52, the bracket body 28, block 46, washers 53 and nut 54 are assembled on the anchor bolt 51 as shown in FIG. 4. With the first bracket assembly 26 installed, the remaining bracket assemblies 26 can be similarly installed. A recommended procedure to accomplish this task is to use the tracks 13 with factory-installed upstanding threaded studs 55 to laterally locate the remaining bracket assemblies 16. A first stud 55 is inserted into the proper slot 47 in the central bracket body 28. The central bracket assembly 28 can be provided with a double set of slots 47 to receive respective studs 55 at the ends of left and right sections of the tracks 13. The tracks 13 are preliminarily leveled and temporarily held in place with suitable clamps and/or props. Other bracket assemblies 26 are positioned so that appropriate studs 55 are received in their respective slots 47. Holes 52 are drilled in the shaft wall header 27 at the center of the slots 42 of the additional bracket assemblies 26 and these bracket assemblies are provisionally installed as described for the center bracket assembly. A track spacer plate 56 has holes for receiving and locating the studs 55, and therefore locating the tracks 13 in a desired spacing relative to one another. A spacer plate is associated with each bracket 26. Nuts 57 are assembled on upstanding track studs 55 to fasten the tracks 13 to the brackets 26. The slots 47 permit the tracks 13 to be adjusted horizontally towards and away from the shaft wall 17 as required.

In the illustrated arrangement, as described above, each door panel 11 has an associated hanger or bracket 16 on which is assembled a pair of traction rollers 14. The hangers or brackets 16 are installed with the rollers on the track support surfaces 23. With the hangers 16 located on appropriate tracks 13, the door panels 11 can be bolted onto the hangers. For example, bolts (not shown), assembled vertically through holes in horizontal webs of the hangers 16 can be turned into threaded holes in the upper edges of the door panels 11 to secure the door panels to the hangers. With each door panel 11 secured to a respective hanger 16, the panels are suspended overhead from the tracks 13.

The bracket assemblies 26 afford a convenient, accurate and fast way of adjusting a gap 61 (FIG. 5) between the bottom of the door panels 11 and the sill 21 to meet building code requirements and assure smooth opening and closing operation of the door panels. With the nuts 54 slightly loose on the studs of the anchor bolts 51, the jack screws 41 can be rotated in either direction as needed to raise or lower the tracks 13 and, therefore, the door panels 11. The jack screws 41 bear against the top surface of their respective blocks 46 thereby transferring the weight of the tracks 13 and door panels 11 to the anchor bolt 51 while allowing the respective bracket assemblies 26 to move vertically within limits of the slots 42. One or more bracket assemblies 26 are adjusted as necessary. The adjustment mechanism afforded by the jack screw 41 has the desirable characteristic of being linear, lifting or lowering the door panels 11 a distance directly proportional to the angle through which a screw is turned. All of the door panels 11 are adjusted at the same time rather than being adjusted one at a time. When the door panels have been properly adjusted, each of the bracket assemblies 26 can be locked in position by drilling a hole in the building wall header 27 using the hole 43 as a pilot. Thereafter, an anchor bolt 63, shown in phantom in FIG. 4, is positioned through the bracket hole 43 into the drilled hole. A nut 64 on this second anchor 63 can then be tightened for additional securement of the bracket assembly 26. Additionally, the nut 54 associated with the first anchor bolt 51 is fully tightened at this time.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method of installing entrance doors at an elevator landing comprising the steps of mounting a track at the header of a landing opening, and mounting a sill at the level of the floor at the opening, hanging door panels from the track by supporting the weight of the doors by sets of rollers resting on horizontal surfaces of the track, adjusting the height of the lower edges of the panels above the sill by moving the track up or down as required while the door panels remain suspended on the track, the track being suspended under a plurality of brackets supported on the header, the brackets being carried on anchor bolts in the header of the opening, the brackets being provided with jacking screws arranged when turned to move the brackets up or down relative to said anchor bolts, and the anchor bolts being tightened on the brackets after the brackets are vertically adjusted.

2. A method as set forth in claim 1, wherein each bracket is vertically supported by a single anchor bolt projecting horizontally from the header when an associated jacking screw is actuated.

3. A method as set forth in claim 2, wherein each jacking screw is arranged with a vertical axis passing through an axis of the associated anchor bolt.

4. A method as set forth in claim 3, wherein the jacking screw is disposed above the associated anchor bolt.

* * * * *